US009874853B2

(12) United States Patent
Kataoka

(10) Patent No.: US 9,874,853 B2
(45) Date of Patent: Jan. 23, 2018

(54) IMAGE FORMING APPARATUS

(71) Applicant: CANON KABUSHIKI KAISHA, Tokyo (JP)

(72) Inventor: Hisashi Kataoka, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/234,890

(22) Filed: Aug. 11, 2016

(65) Prior Publication Data

US 2017/0052506 A1 Feb. 23, 2017

(30) Foreign Application Priority Data

Aug. 18, 2015 (JP) ..... 2015-161354

(51) Int. Cl.
*G03G 15/00* (2006.01)
*G03G 21/16* (2006.01)

(52) U.S. Cl.
CPC ..... *G03G 21/1695* (2013.01); *G03G 15/6502* (2013.01); *G03G 15/6511* (2013.01); *G03G 21/1633* (2013.01); *G03G 21/1638* (2013.01)

(58) Field of Classification Search
CPC ..... G03G 21/1695
USPC ..... 399/393
See application file for complete search history.

(56) References Cited

U.S. PATENT DOCUMENTS 7,620,344 B2 * 11/2009 Igarashi ..... G03G 15/167 399/110
2002/0061206 A1 * 5/2002 Enomoto ..... G03G 15/6502 399/124
2006/0198675 A1 * 9/2006 Yamamoto ..... B65H 1/00 399/392
2010/0124449 A1 * 5/2010 Asada ..... B65H 1/04 399/393
2015/0050059 A1 * 2/2015 Sato ..... G03G 15/6502 399/393

FOREIGN PATENT DOCUMENTS

JP 2009184799 A 8/2009

* cited by examiner

*Primary Examiner* — Anthony Nguyen
(74) *Attorney, Agent, or Firm* — Canon U.S.A., Inc. IP Division

(57) ABSTRACT

A protective member is provided in a detachably attachable manner on a side wall of a sheet feeding cassette such that an opening cover of an image forming apparatus does not come into contact with a sheet guide surface. In a drawing out direction of a cassette storing sheets, a range in which an upper surface of the protective member extends overlaps at least a portion of a range in which the sheet guide surface extends. The upper surface of the protective member is vertically positioned at a position higher than a position of the sheet guide surface.

24 Claims, 15 Drawing Sheets

IMAGE FORMING APPARATUS

BACKGROUND

Field

Aspects of the present disclosure generally relate to an image forming apparatus including a sheet storing portion in which sheets are stored.

Description of the Related Art

In image forming apparatuses, such as copiers and printers, a configuration in which a sheet is sent out to an image forming portion from a sheet storing portion, provided at the bottom of an apparatus main body, in which sheets are stored is typically used. A portion of an exterior cover of the apparatus main body is formed as a cover that is capable of being opened and closed so that maintenance of the image forming portion and a jam clearing process can be carried out. By opening such a cover, work space is obtained.

When the opening cover is opened in a state in which the sheet storing portion has been drawn out from the apparatus main body, depending on the locus of the opening cover, there are cases in which the cover comes into contact with the sheet storing portion. When a dent or the like is created in the sheet guide surface being in contact with the cover, even if the dent or the like is small, it leads to a so-called jamming or skewing of the conveyed sheet.

In order to overcome the above problem, Japanese Patent Laid-Open No. 2009-184799 proposes a configuration in which the sheet guide surface is protected with a protective plate made of metal or the like.

In the configuration described in Japanese Patent Laid-Open No. 2009-184799, the protective plate needs to be attached to the sheet guide surface in order to protect the sheet guide surface. In other words, assembling the above configuration is time consuming and laborious.

SUMMARY

The present disclosure provides an image forming apparatus that forms an image on a sheet, the image forming apparatus including a sheet storing portion, storing a sheet therein, mountable in a main body of the image forming apparatus and capable of being drawn out of the main body, a feeding unit configured to feed the sheet stored in the sheet storing portion, a cover disposed vertically above the sheet storing portion and capable of moving between a closed position and an open position, and a protective member. In the image forming apparatus, the sheet storing portion includes a side wall and a sheet guide surface that guides the sheet fed with the feeding unit. In a state where the sheet storing portion is drawn out from the main body, when the cover is moved from the closed position towards the open position, the cover comes into contact with the protective member and does not come in contact with the sheet guide surface. The protective member is provided on the side wall in a detachably attachable manner.

Further features of aspects of the present invention will become apparent from the following description of exemplary embodiments with reference to the attached drawings.

DESCRIPTION OF THE EMBODIMENTS

First Exemplary Embodiment

Figure 1:
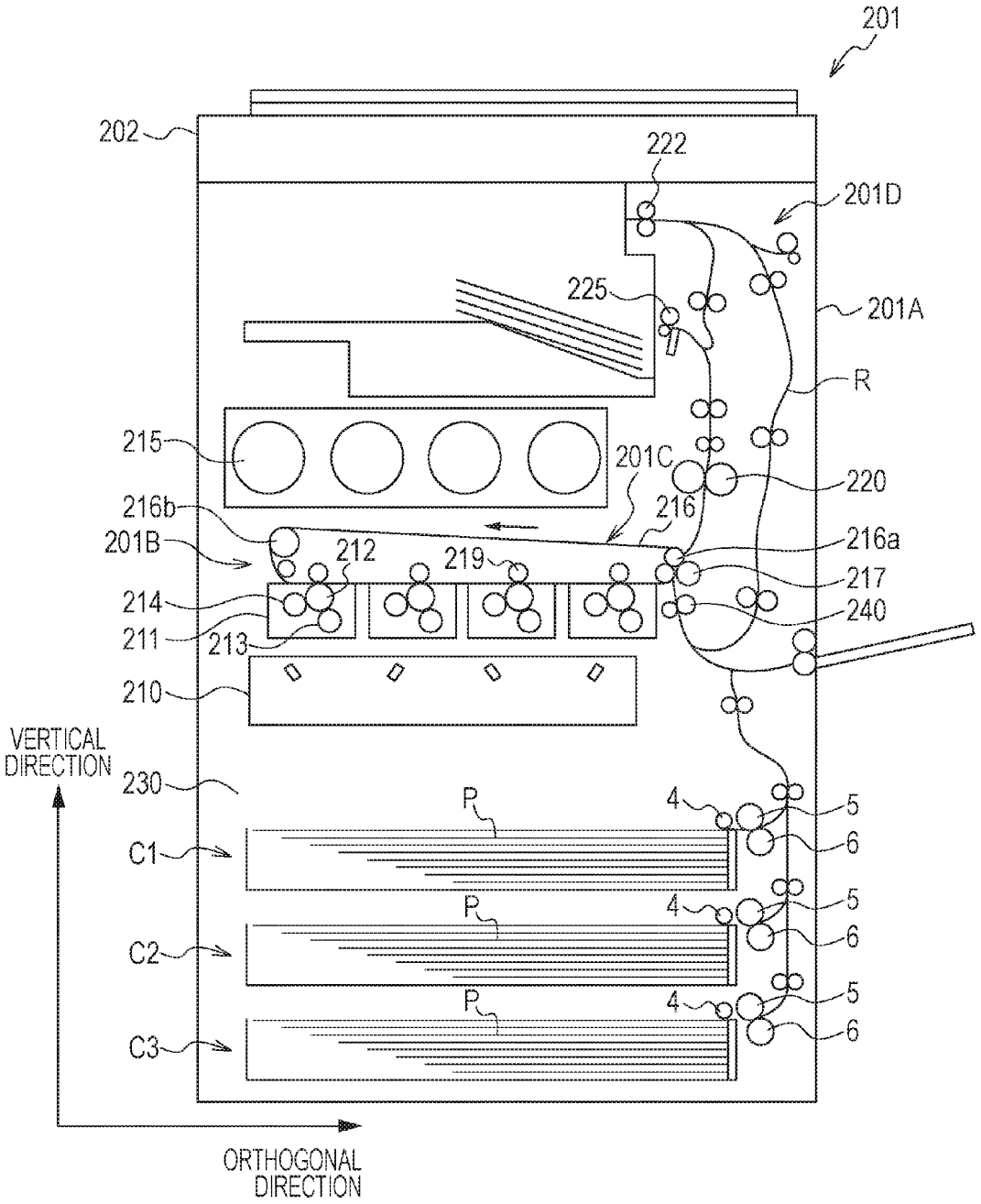
FIG. 1 is a front view of an entirety of an image forming apparatus.

FIG. 1 is a diagram illustrating a schematic configuration of a copier that is an example of an image forming apparatus according to the present disclosure. Referring to FIG. 1, a copier 201 includes a printer main body 201A that is an image forming apparatus main body, an image forming portion 201B that forms an image on a sheet, a fixing portion 220, and an image reader 202. The image reader 202 is disposed vertically above the printer main body 201A. A discharge space for discharging a sheet is formed between the image reader 202 and the printer main body 201A. A sheet feeding device 230 serving as a feeding unit configured to feed, sheet by sheet, the sheets stored in a sheet cassette C1 serving as a sheet storing portion is disposed in the lower portion of the printer main body 201A.

The image forming portion 201B is a four-drum full-color system including a laser scanner 210 and four image forming units 211 that form toner images of four colors, namely, yellow (Y), magenta (M), cyan (C), and black (K). Furthermore, an intermediate transfer unit 201C is disposed above the image forming units 211. Toner images formed on the image forming units are transferred onto the sheet through the intermediate transfer unit 201C.

The sheets fed sheet by sheet by the sheet feeding device is conveyed with a registration roller pair 240, and any skew is corrected by the registration roller pair 240. Subsequently, the sheet is conveyed to a secondary transfer portion with the registration roller pair 240 at a timing in which the toner image formed on an intermediate transfer belt 216 coincides with the sheet such that the toner images on the intermediate transfer belt 216 are transferred onto the sheet.

The sheet on which the toner images have been transferred receives heat and pressure at the fixing portion 220 and the toner images are fixed to the sheet. The sheet P to which the image has been fixed is discharged to and is stacked in the discharge space with a discharge roller pair 225.

FIGS. 2A to 2D are diagrams to describe the problem that the present exemplary embodiment aims to overcome. A cover 20 is provided to expose the image forming portion 201B and the sheet conveyance path R when maintenance is being performed. When the user performs maintenance, such as replacing the image forming units 211 and cleaning the intermediate transfer unit 201C, the cover 20 is opened by the user. Furthermore, when a jamming occurs, the cover 20 plays a role in enabling the jammed sheet to be removed by exposing the sheet conveyance path R.

The cover 20 is supported by a rotary arm 20*c* in a rotatable (movable) manner about a rotation center 20*d*. A rotation axis of the rotation center 20*d* extends in an orthogonal direction that is orthogonal to the vertical direction and to a direction in which the sheet cassettes are drawn out. During normal times, the cover 20 is in a state illustrated in FIG. 2A; however, during maintenance, the cover 20 is rotated about the rotation center 20*d* to a state illustrated in FIG. 2C. Accordingly, the locus of the rotating cover 20 is an open/close locus illustrated in FIG. 2D.

Figure 2A:
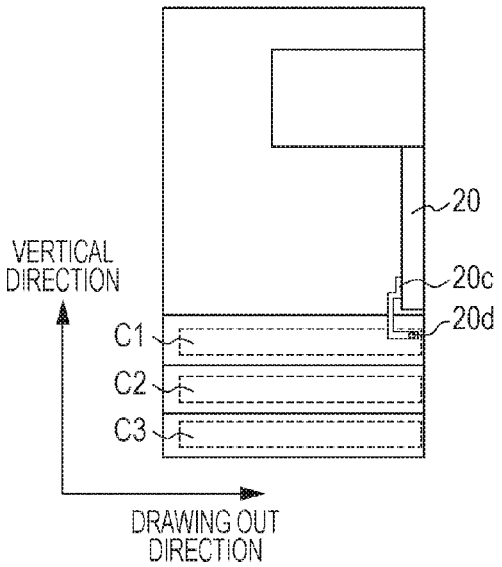
FIGS. 2A to 2D are side views illustrating movements of an opening cover and a sheet storing portion.
Figure 2B:
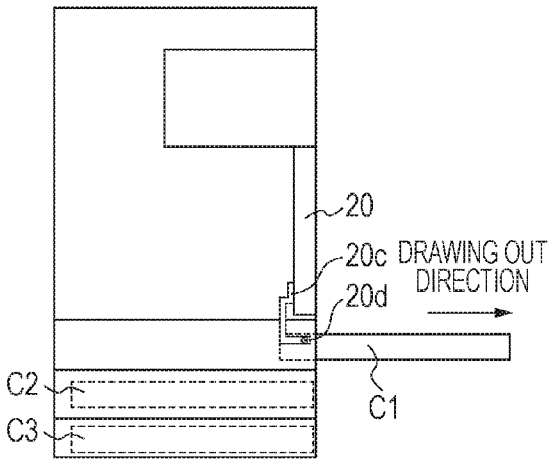
Figure 2C:
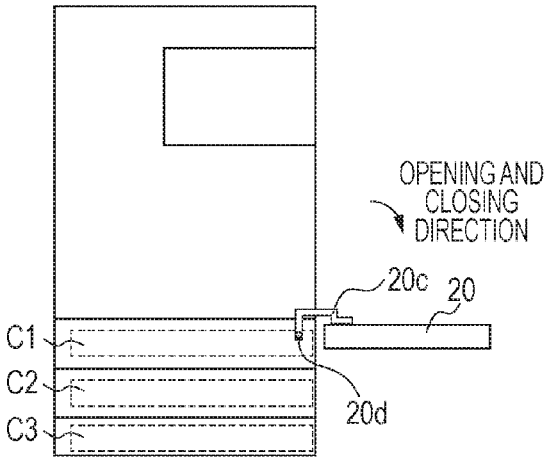
Figure 2D:
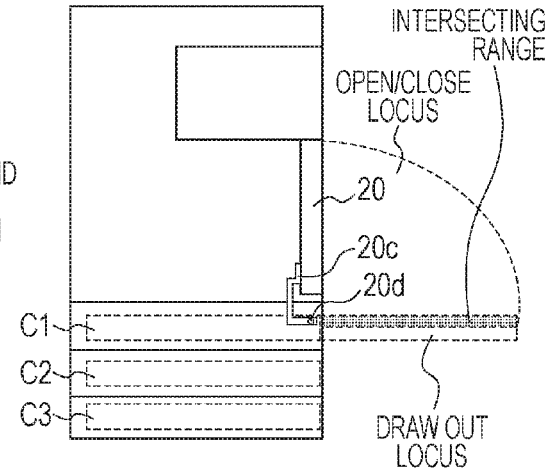

Meanwhile, the sheet cassette C1 slides from a stored position illustrated in FIG. 2A to a drawn out position illustrated in FIG. 2B. Accordingly, the locus of the sliding sheet cassette is a slide locus illustrated in FIG. 2D. As illustrated in FIG. 2D, the open/close locus and the slide locus intersect each other. The above implies that when the sheet cassette C1 and the cover 20 are opened at the same time, the sheet cassette C1 and the cover 20 come in contact with each other. The present exemplary embodiment aims to prevent deformation and a flaw of the sheet cassette C1 from being created upon such a contact.

Figure 3A:
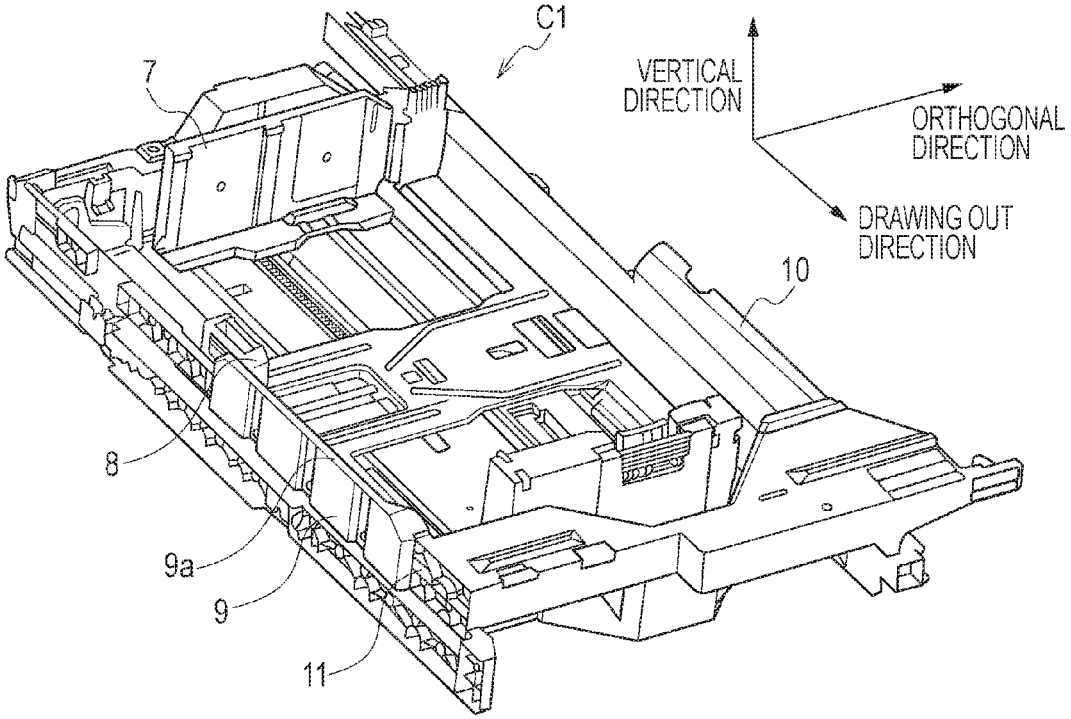
FIGS. 3A and 3B are a perspective view and a plan view, respectively, of a sheet storing portion according to a first exemplary embodiment.
Figure 3B:
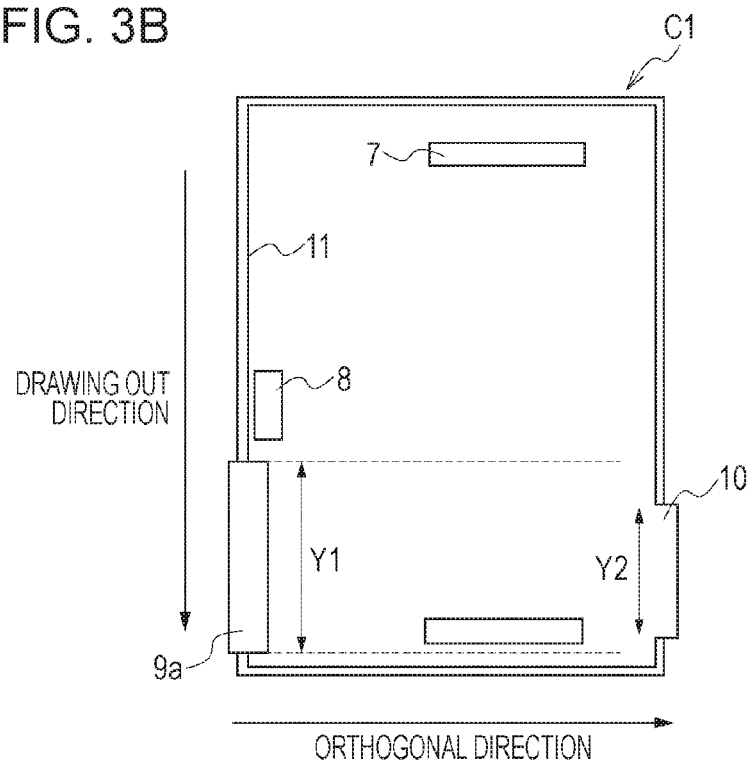

Referring next to FIGS. 3A and 3B, the sheet cassette C1 according to the present exemplary embodiment will be described. FIG. 3A is a perspective view illustrating the entire sheet cassette C1 including a protective member 9 according to the present exemplary embodiment. The drawing out direction illustrated in FIGS. 3A and 3B is the same direction as the drawing out direction illustrated in FIG. 2B.

A sheet guide surface 10 serving as a guide when conveying the sheet is provided in the sheet cassette C1. A drawing out direction restricting member 7 and an orthogonal direction restricting member 8 are provided inside the sheet cassette C1. The drawing out direction restricting member 7 restricts the position of the sheet stored in the sheet cassette C1 in the drawing out direction. The orthogonal direction restricting member 8 restricts the position of the sheet in a direction (the orthogonal direction) that is orthogonal to the drawing out direction. The protective member 9 is attached to the side wall 11 of the sheet cassette C1. As illustrated in FIG. 4B, a positioning boss 11*a* protrudes from the side wall 11. Furthermore, the protective member 9 includes a pair of opposing side plate portions 92 and 93, and the side plate portion 93 includes a positioning hole 91. The position of the protective member 9 with respect to the side wall 11 is set by having the side plate portions 92 and 93 hold the side wall 11 in between and by having the positioning boss 11*a* intrude into the positioning hole 91.

Since the side plate portions 92 and 93 are each formed in a thin plate shape with resin, the side plate portions 92 and 93 are elastic. Since the side plate portions 92 and 93 are elastic, the protective member 9 can be detached from the side wall 11 by spreading the space between the two side plate portions 92 and 93. With such a configuration, attachment/detachment of the protective member 9 with respect to the side wall 11 is facilitated. Since the protective member 9 is formed of resin, the protective member 9 brought into contact with the cover can become deformed. By configuring the protective member 9 in a detachably attachable manner, the present exemplary embodiment has an advantage in that the protective member 9 can be replaced easily when the protective member 9 is deformed and needs to be replaced.

The protective member 9 includes an abutment surface 94 serving as a vertical direction restriction surface and abuts against an upper surface llb of the side wall 11. With the above configuration, the side wall 11 is capable of supporting the protective member 9 that receives a downward load.

Figure 4A:
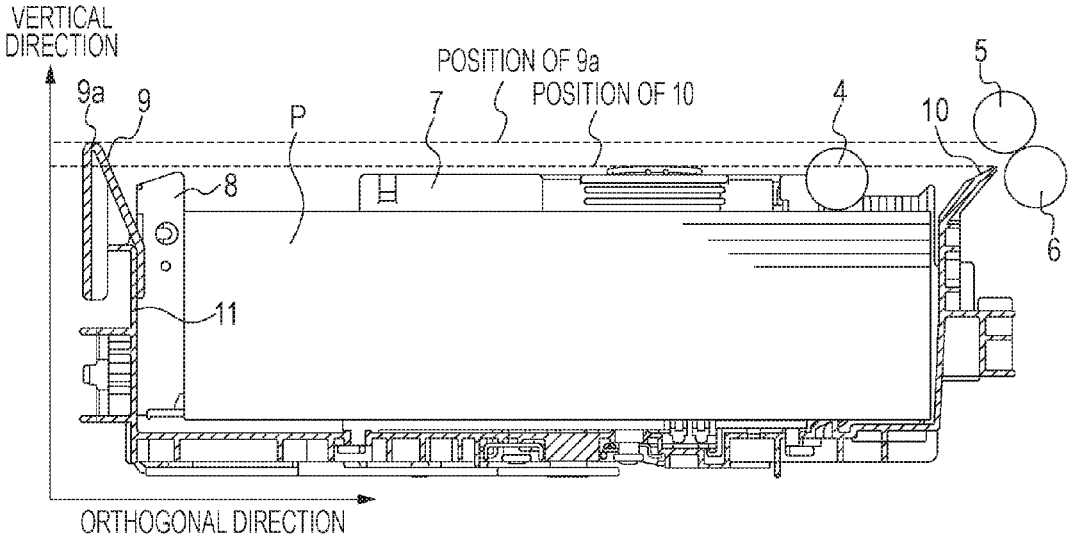
FIGS. 4A to 4C include a cross-sectional view and explanatory drawings of the sheet storing portion.
Figure 4B:
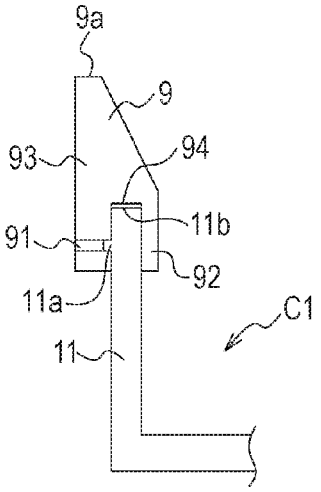
Figure 4C:
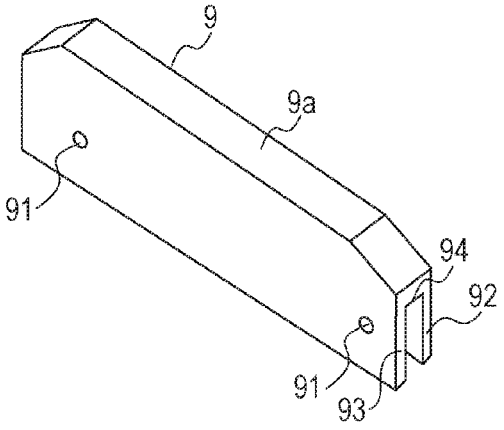

FIG. 4A is a cross-sectional view illustrating positional relationships between the sheet cassette C1 and a pickup roller 4, a feed roller 5, and a retard roller 6. The sheet guide surface 10 guides the sheet P fed with the pickup roller 4 towards a nip portion between the feed roller 5 and the retard roller 6. In the above, the sheet S is conveyed while frictionally sliding along the surface of the sheet guide surface 10. Accordingly, even a slight flaw or dent in the sheet guide surface 10 can disadvantageously jam or skew the sheet caught by the flaw or dent. Accordingly, in order to prevent a jam or a skew from occurring, the surface of the sheet guide surface 10 needs to be protected so that no flaw or dent is created.

Figure 5:
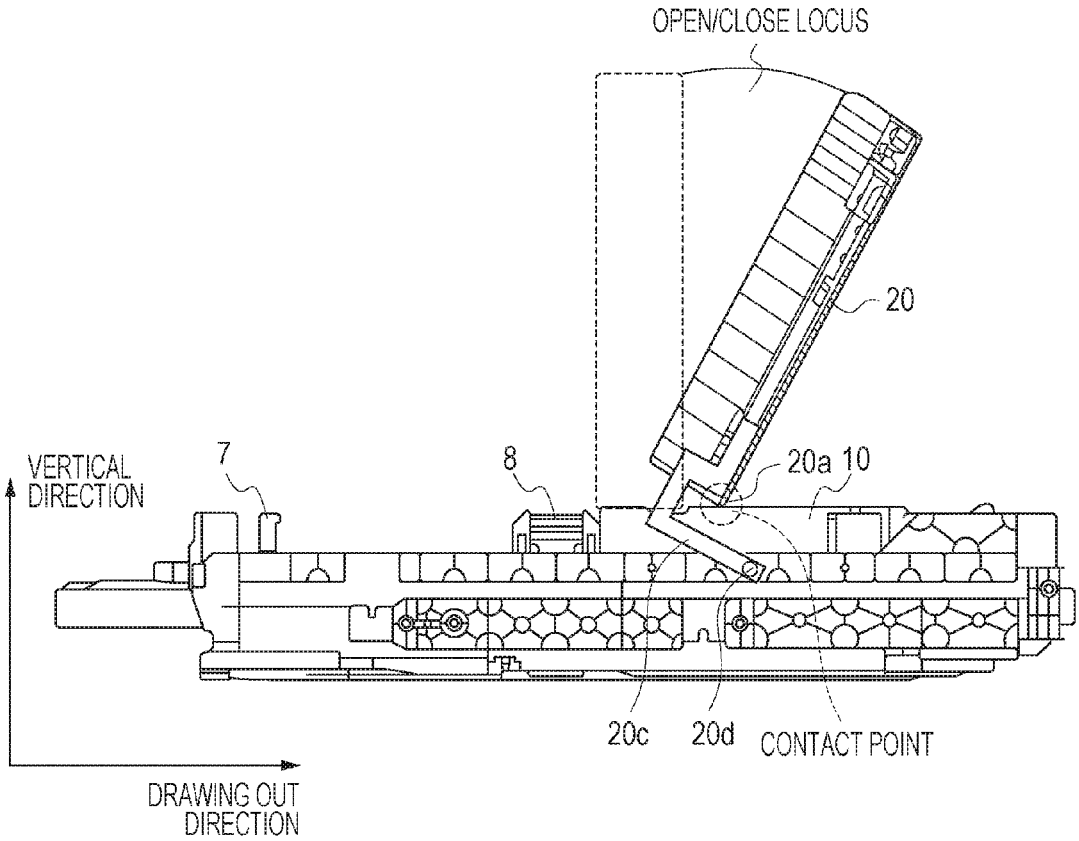
FIG. 5 is a diagram illustrating a state in which the sheet guide surface and the opening cover are in contact with each other when there is no protective member.

Note that as illustrated in FIG. 2D, when the open/close locus of the cover 20 intersects a draw out locus of the sheet cassette C1, then, when the cover 20 is opened after the sheet cassette C1 has been drawn out, the two come into contact with each other. FIG. 5 illustrates a state in which the sheet cassette C1 and the cover 20 are in contact with each other when there is no protective member 9. Specifically, when the cover 20 is rotated about the rotation center 20*d* from a position where the cover 20 is in a closed state (the position depicted by a broken line in FIG. 5), the sheet guide surface 10 and a lower end portion 20*a* of the cover 20 come in contact with each other. When the sheet guide surface 10 and the lower end portion 20*a* of the cover 20 come in contact with each other, a flaw or a dent can be disadvantageously created on the surface of the sheet guide surface 10. In the present exemplary embodiment, considering the cost and weight, the sheet guide surface 10 is formed of resin; accordingly, a flaw or a dent is relatively easily created. Furthermore, even if the sheet guide surface 10 is formed of a metal plate and the like, when the cover 20 comes in hard contact with the sheet guide surface 10, a dent can be created or deformation can occur. In view of the above situation, the protective member 9 is aimed to prevent contact between the cover 20 and the sheet guide surface 10 to protect the sheet guide surface 10.

Figure 6A:
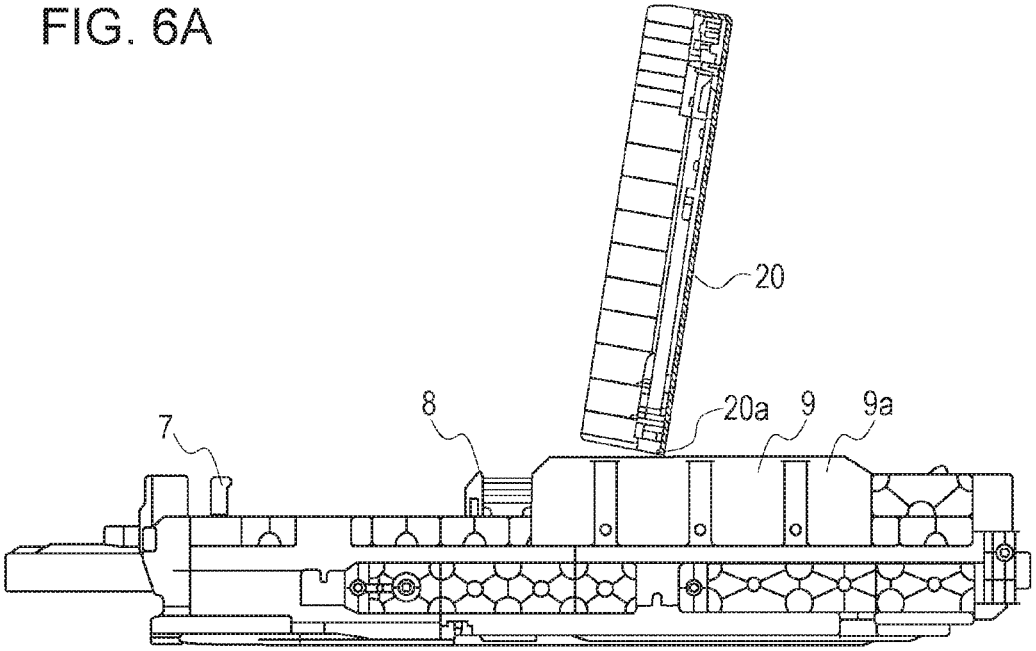
FIGS. 6A and 6B are diagrams illustrating a state in which the opening cover has come in contact with the protective member.
Figure 8A:
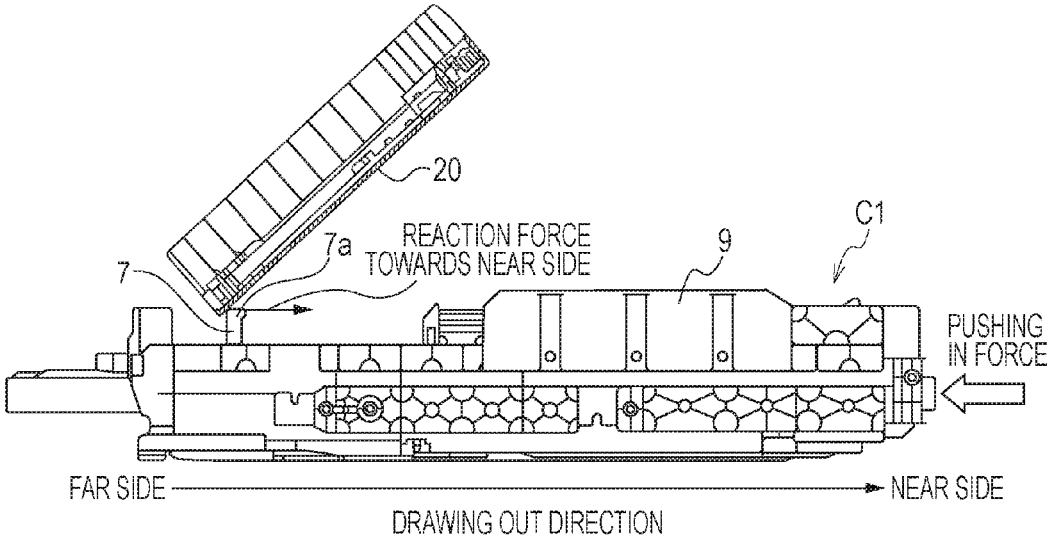
FIGS. 8A and 8B are diagrams illustrating states in which the opening cover has entered a portion in front or behind a drawing out direction restricting member.

Note that in FIG. 5, the position of the rotation center 20*d* of the cover 20 is depicted in order to illustrate the positional relationship between the cover 20 and the sheet cassette C1; however, the illustration of the rotation center 20*d* is omitted in the succeeding drawings, such as FIGS. 6A and 8A.

Figure 6B:
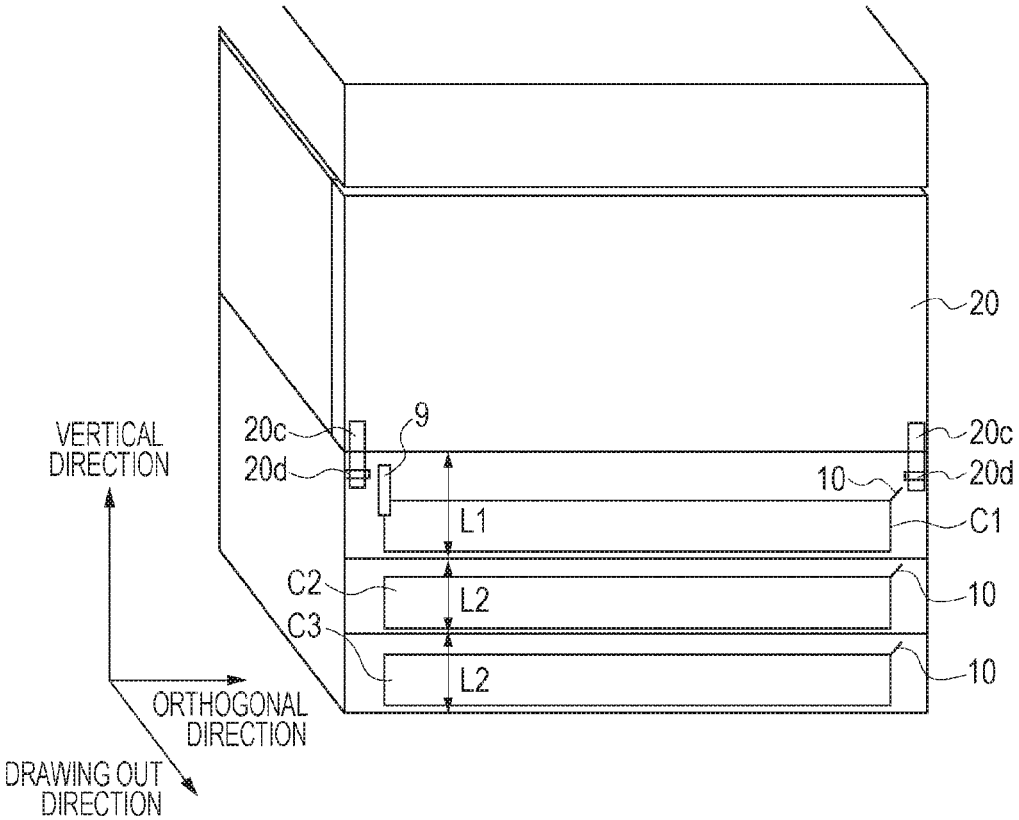

A method of protecting the sheet guide surface 10 with the protective member 9 will be described next. An upper surface 9*a* of the protective member 9 is positioned at a vertically higher position with respect to the position of the sheet guide surface 10 (FIG. 4A). Furthermore, as illustrated in FIG. 6B, the cover 20 is rotatably supported by two coaxial rotation centers 20*d* disposed along the same axis. Furthermore, the cover 20 is mounted across the protective member 9 and the sheet guide surface 10. Specifically, the width of the cover 20 is wider than an area from the protective member 9 to the sheet guide surface 10. Accordingly, when the cover 20 is opened after the sheet cassette C1 is drawn out from the image forming apparatus main body, the lower end portion 20*a* of the cover 20 abuts against the protective member 9 before any abutment against the sheet guide surface 10 and stops while abutting against the protective member (FIG. 6A). Furthermore, as illustrated in FIG. 3B, the upper surface 9*a* of the protective member 9 is disposed in a range Y1 in the drawing out direction. Y1 is a range of protection of the protective member 9. In other words, a portion in the sheet guide surface 10 overlapping the range Y1 in the drawing out direction is protected from being in contact with the cover 20. In the present exemplary embodiment, the sheet guide surface 10 is disposed in a range Y2 illustrated in FIG. 3B. Since the range Y2 is included in the range Y1, the entire area of the sheet guide surface 10 is protected by the protective member 9. Accordingly, wherever the draw out locus of the sheet cassette C1 is positioned, the sheet guide surface 10 is protected from being in contact with the cover 20 with the protective member 9.

As described above, since the sheet guide surface 10 and the cover 20 do not come into contact with each other, the sheet guide surface 10 can be protected from a flaw or a dent being created therein owing to coming in contact with the cover 20.

Incidentally, the cover 20 is an element that is operated by the user during a jam clearing process, and can be operated with an unanticipated strong force. Furthermore, the rotation centers 20*d* of the cover 20 are positioned in the vicinities of the sheet cassette C1 (FIG. 6B). When a portion (a point of action) receiving force is closer to the rotation center than a portion where an operation is performed (a power point), force that is stronger than the force acting on the power point acts on the point of action. In the present exemplary embodiment as well, when the cover 20 comes in contact with the upper surface 9*a* of the protective member 9, force that is larger than the physical force applied by the user acts on the upper surface 9*a* of the protective member 9. There can be a case in which the replacement of the protective member 9 is required due to deformation of the protective member 9.

In a case in which the protective member 9 needs to be replaced due to deformation thereof, if the protective member 9 is not detachably attachable with respect to the side wall 11, the entire sheet cassette C1 will be replaced. Conversely, in the present exemplary embodiment, since it is only sufficient to replace the protective member 9, cost can be reduced.

Furthermore, even if the protective member 9 can be detached, if it is not easy to detach the protective member 9, replacement work of the protective member 9 will be carried out for a long period of time in an office or the like of the user, which is where the image forming apparatus is installed. During that period, the image forming apparatus cannot be used and the user may feel dissatisfied. In the present exemplary embodiment, the elastic side plate portions 92 and 93 of the protective member 9 hold the side wall 11 in between and positioning boss 11*a* of the side wall 11 intrudes into the positioning hole 91. With such a configuration, attachment/detachment of the protective member 9 with respect to the side wall 11 is facilitated. With the above, the present exemplary embodiment is capable of replacing the protective member 9 in a short time without making the user feel dissatisfied.

Furthermore, as C1 to C3 illustrated in FIG. 1, when a plurality of sheet cassettes are provided in the image forming apparatus, it is desirable that the shapes of the sheet cassettes are the same in consideration of the productivity and ease of maintenance. However, the sheet cassette that can come into contact with the cover 20 is the sheet cassette C1 that is closest to the cover 20, and the other sheet cassettes C2 and C3 do not have to be protected.

Note that one can conceive of preventing the sheet guide surface 10 and the cover 20 from coming into contact with each other without providing the protective member 9 by forming the side wall 11 higher than the sheet guide surface 10. However, when the height of the side wall 11 is increased, the exclusive space becomes larger by the increased amount. When cassettes that are the same as the sheet cassette C1 are used in the sheet cassettes C2 and C3, the increased exclusive spaces will be a waste.

Figure 7A:
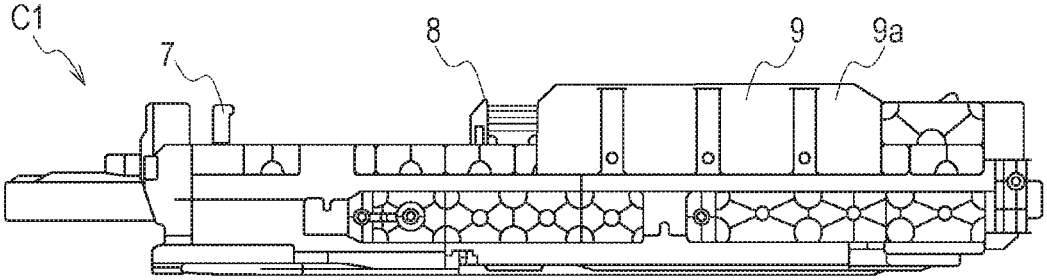
FIGS. 7A and 7B are diagrams comparing the sheet storing portions C1 and C2 according to the first exemplary embodiment.
Figure 7B:
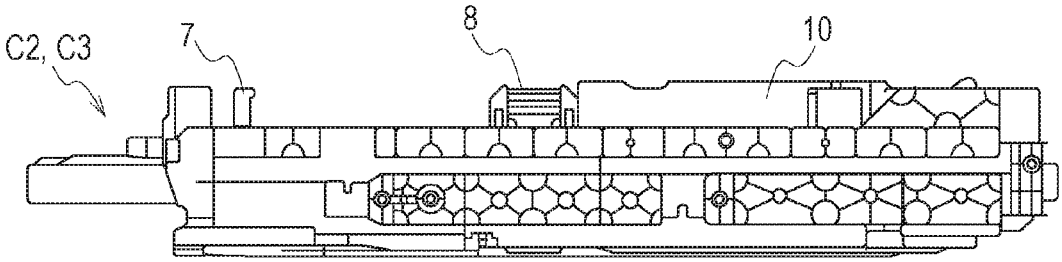

In the present exemplary embodiment, sheet cassettes having the same shape are used in which a sheet cassette on which the protective member 9 is mounted is used as the sheet cassette C1 (FIG. 7A) and sheet cassettes on which the protective members 9 are not mounted are used as the sheet cassettes C2 and C3 (FIG. 7B). In the above case, L1 is a height in the vertical direction of the sheet cassette C1 including the protective member 9. Similarity, L2 is a height of each of the sheet cassettes C2 and C3 in the vertical direction. Since L1 includes the height of the protective member 9 and L2 does not include the height of the protective member 9, the value of L2 is smaller the value of L1. In other words, by not attaching the protective member 9 to the sheet cassettes C2 and C3, the exclusive space of each of the sheet cassettes C2 and C3 can be made smaller than the exclusive space of the sheet cassette C1. By facilitating the attachment and detachment of the protective member 9 in the above manner, the exclusive spaces can be reduced while most of the sheet cassette is used commonly. With the above configuration, it will be possible to respond to the demand for reduction in size of the apparatus.

Second Exemplary Embodiment

In the present exemplary embodiment, in addition to the protection of the sheet guide surface 10 described in the first exemplary embodiment, protection of the drawing out direction restricting member 7 is considered. The present exemplary embodiment has a similar shape to that of the first exemplary embodiment except for the shape of the protective member; accordingly, description other than the protective member is omitted.

Figure 8B:
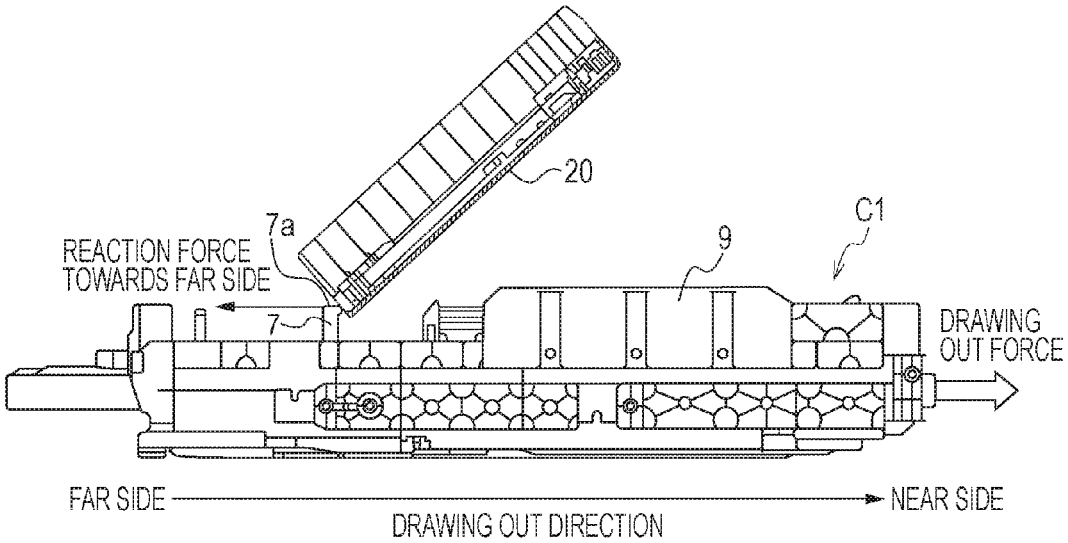
Figure 9A:
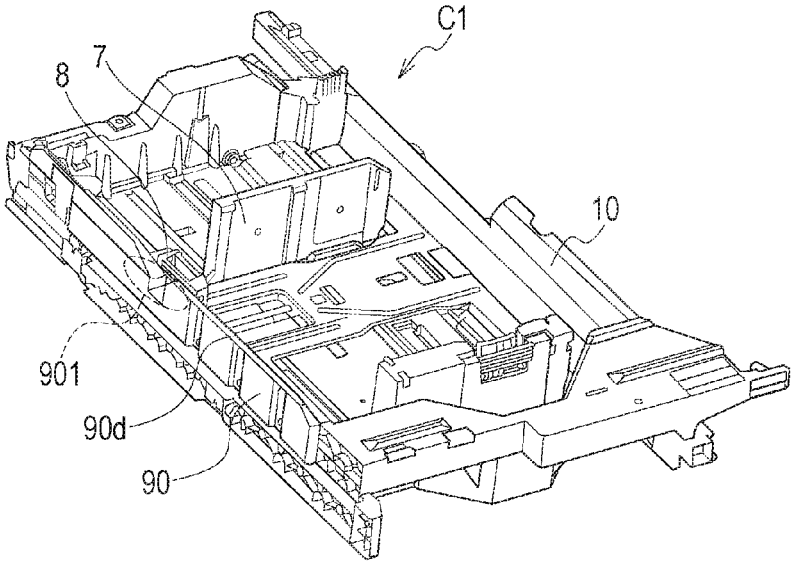
FIGS. 9A to 9C are explanatory drawings of the sheet storing portion according to a second exemplary embodiment.
Figure 9B:
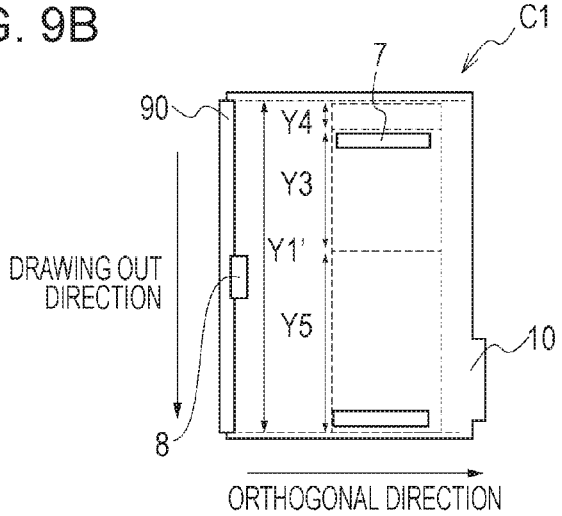

A problem that is to be overcome with the present exemplary embodiment will be described first. When using the drawing out direction restricting member 7, the position thereof with respect to the sheet cassette C1 is changed according to the size of the sheet. In the present exemplary embodiment, the drawing out direction restricting member 7 can be moved within a range of a movable range Y3 (FIG. 9B). Note that FIGS. 8A and 8B are diagrams illustrating a positional relationship between the drawing out direction restricting member 7 and the cover 20, and a direction in which the user draws out the sheet cassette C1 is a near side and the opposite direction is a far side. When the cover 20 is opened after drawing out the sheet cassette C1, as Illustrated in FIG. 8A, there is a case in which the cover 20 moves into the far side with respect to the drawing out direction restricting member 7. When the sheet cassette C1 is pushed into the far side in the above state, reactive force towards the near side is applied to the drawing out direction restricting member 7. Similarity, as illustrated in FIG. 8B, in a state in which the cover 20 has been moved into the near side of the drawing out direction restricting member 7, when a force drawing out the sheet cassette towards the near side in applied, reactive force towards the far side acts on the drawing out direction restricting member 7. The drawing out direction restricting member 7 can disadvantageously become deformed due to force applied towards the near side or the far side. The drawing out direction restricting member 7 is a member that restricts the position of the sheet stored in the sheet cassette C1 and when deformed, the drawing out direction restricting member 7 will not be able to restrict the position of the sheet in a normal manner. When the position of the sheet is not restricted in a normal manner, skewing and jamming of the sheet can occur.

Figure 9C:
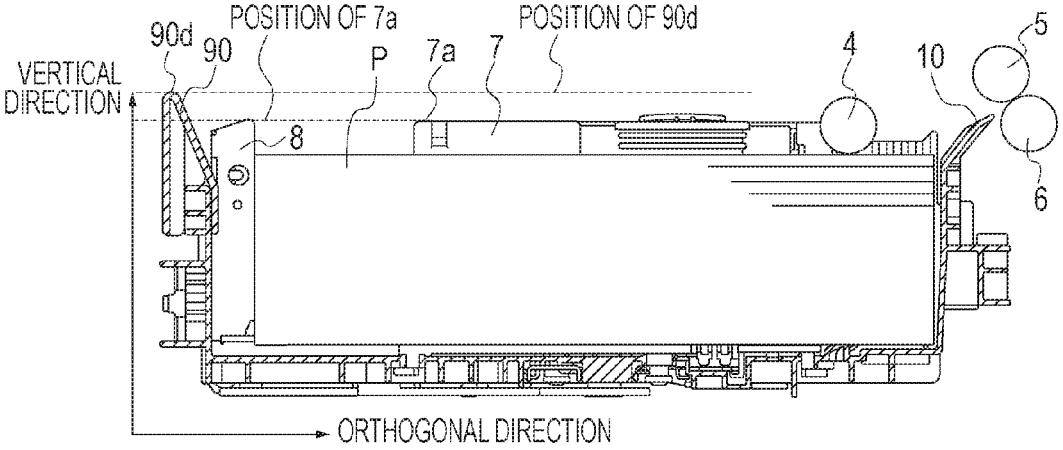

In order to prevent such deformation, in the present exemplary embodiment, the cover 20 is prevented from entering the near side or the far side of the drawing out direction restricting member 7. The range of protection Y1 of the protective member according to the first exemplary embodiment corresponds to the range in which the sheet guide surface 10 existed; however, in the present exemplary embodiment, the range of protection is extended further. FIG. 9B is a diagram illustrating a range of protection Y1' of a protective member 90 according to the present exemplary embodiment. Specifically, the range of protection Y1' includes, in addition to the movable range Y3 of the drawing out direction restricting member 7, a range Y5 on the near side with respect to the movable range Y3, and a range Y4 on the far side. An upper surface 90*d* of the protective member 90 in the vertical direction is positioned at a position that is higher than the position of an upper surface 7*a* of the drawing out direction restricting member 7 (FIG. 9C). Accordingly, the cover 20 does not enter the near side or the far side of the drawing out direction restricting member 7. With the above configuration, deformation of the drawing out direction restricting member 7 due to force in a collapsing direction can be prevented.

Figure 11:
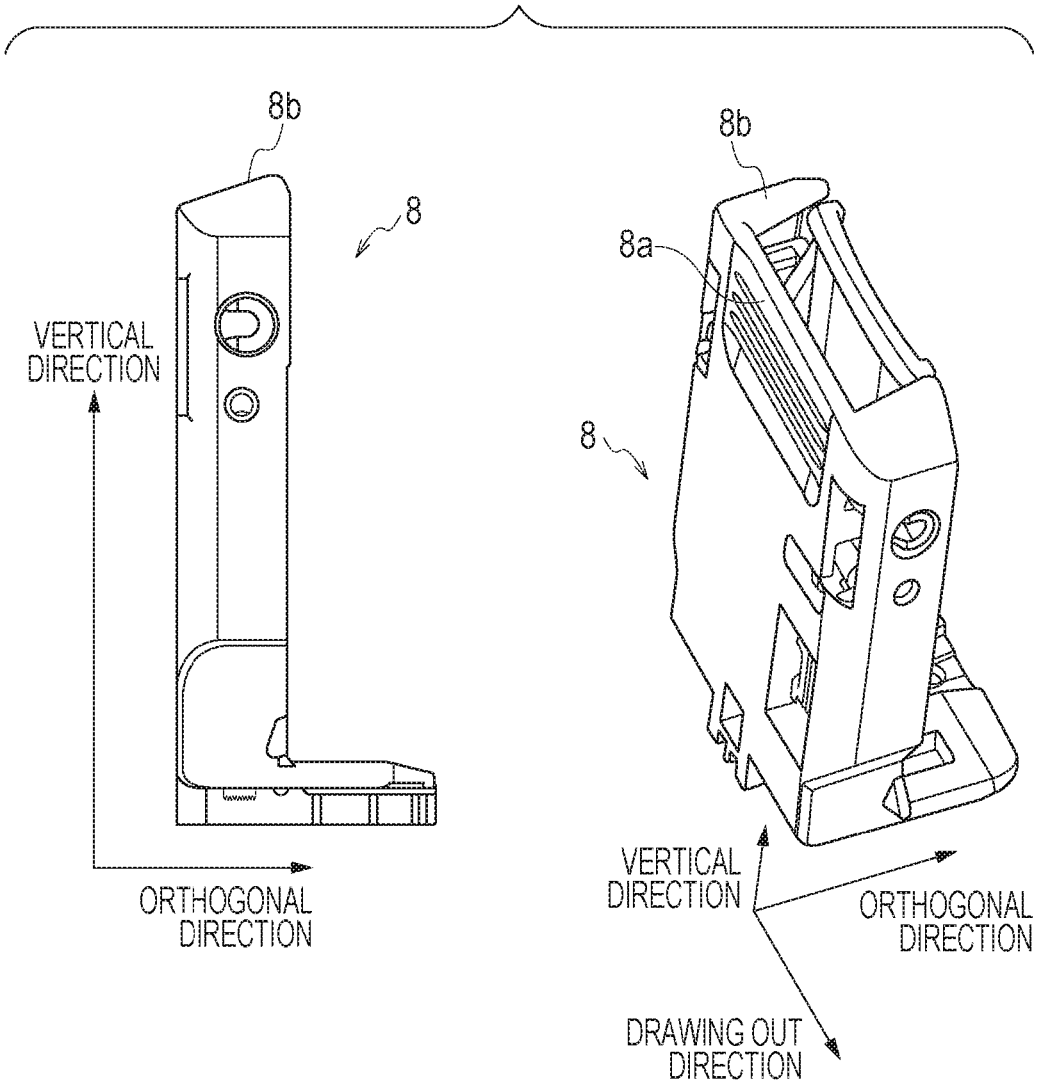
FIG. 11 is a diagram illustrating a shape of an orthogonal direction restricting member.

Incidentally, a tab 8*a* for releasing a lock is provided in an upper end portion of the orthogonal direction restricting member 8 (FIG. 11). When operating the tab 8*a*, there are cases in which the protective member 90 becomes an obstacle to the operation. Considering the above, a portion where the height of the protective member 90 is partially lowered, that is, a recess portion 901 is provided in the protective member 90 according to the present exemplary embodiment to secure the operation space of the tab 8*a*. A bottom 90*a* of the recess portion 901 is positioned at a height in the vertical direction that is lower than a position of an upper surface 8*b* of the orthogonal direction restricting member 8. Furthermore, the position of the recess portion 901 in the drawing out direction is set so as to coincide with the position of the orthogonal direction restricting member 8. With the above configuration, a space for operating the tab 8*a* can be secured.

Figure 10A:
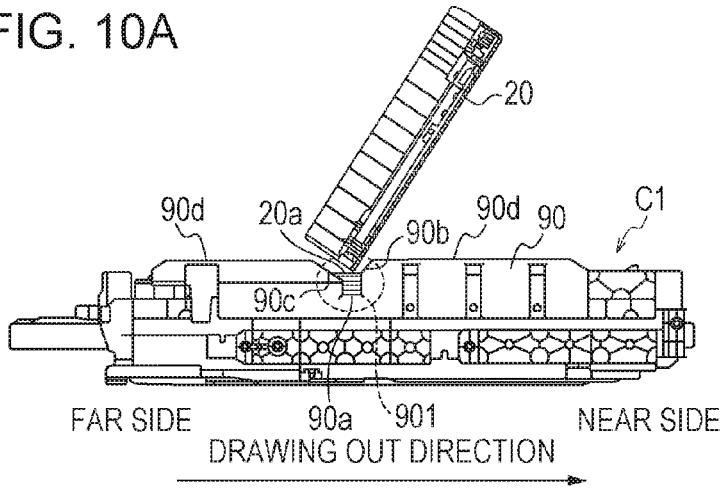
FIGS. 10A to 10C are diagrams illustrating positional relationships between the sheet storing portion according to the second exemplary embodiment and an opening cover.

Because of the recess portion 901, as illustrated in FIG. 10A, there will be cases in which the orthogonal direction restricting member 8 comes into contact with the cover 20; however, there is little possibility of the orthogonal direction restricting member 8 becoming damaged. The above is because, when in contact, a downward load is mainly applied to the orthogonal direction restricting member 8 and hardly any force in the drawing out direction is applied thereto. In a state illustrated in FIG. 10A, when the sheet cassette C1 is slid towards the near side or the far side, the lower end portion 20*a* of the cover 20 slides on the upper surface 8*b* of the orthogonal direction restricting member 8. The upper surface 8*b* of the orthogonal direction restricting member 8 has a smooth and flat surface so that the orthogonal direction restricting member 8 does not become caught and so that no force, owing to such sliding, is applied to the orthogonal direction restricting member 8 in the left-right direction (FIG. 11). Accordingly, force acting on the orthogonal direction restricting member 8 in the left-right direction is small.

On the other hand, the orthogonal direction restricting member 8 receives a strong downward load; however, the orthogonal direction restricting member 8 is shaped so that it does not easily become damaged when receiving such a load (FIG. 11). Specifically, the orthogonal direction restricting member 8 having a function of aligning the stack of sheets P has a wall-shape that extends in an up-down direction. When the shape extending in the up-down direction receives a downwards load, a stress mainly in a compressing direction is applied to the member. Generally, a member is not easily damaged by stress in the compressing direction; accordingly, the orthogonal direction restricting member 8 can maintain sufficient strength against the downwards load that the orthogonal direction restricting member 8 can receive.

Furthermore, there can be a case in which a dent is created in the upper surface 8*b* of the orthogonal direction restriction member 8 when coming into contact with the lower end portion 20*a* of the cover 20; however, since the upper surface 8*b* is not a portion that comes into contact with the sheet, even if a dent is created, no functional problem, such as jamming or skewing, occurs.

Figure 10B:
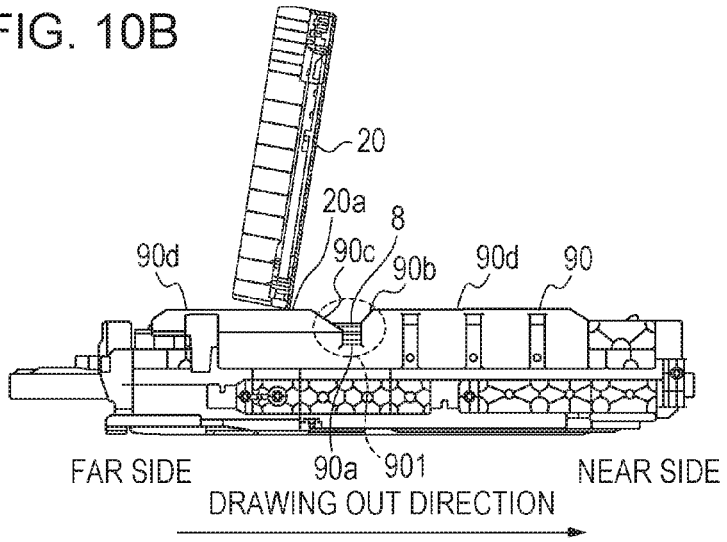
Figure 10C:
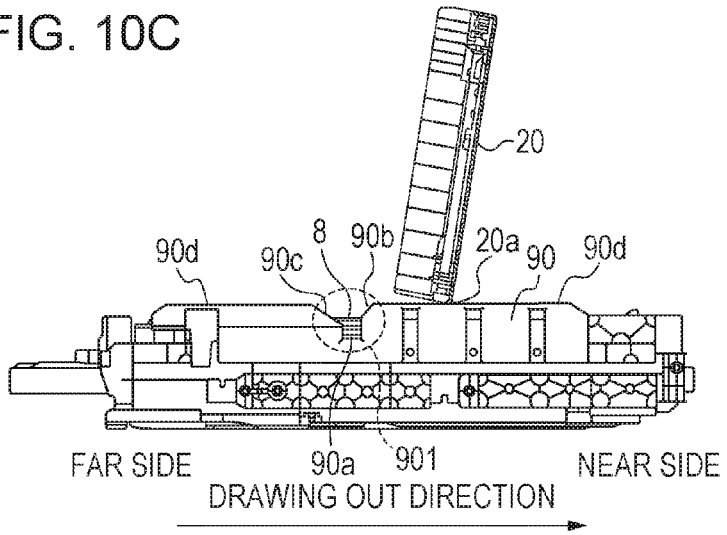

Incidentally, inclined portions 90*b* and 90*c* are provided in the portions that connect the recess portion 901 and the upper surface 90*d* (FIG. 10A). The above have been provided so as to prevent the component from being damaged when the sheet cassette is pushed in and drawn out while the cover 20 is in the recess portion 901. Specifically, from a state illustrated in FIG. 10A, when the sheet cassette C1 is drawn out towards the near side, the lower end portion 20*a* moves upwards along the inclined portion 90*c* and reaches the upper surface 90*d* of the protective member 90 (FIG. 10B). Furthermore, from the state illustrated in FIG. 10A, when the sheet cassette C1 is pushed in towards the far side, the lower end portion 20*a* moves upwards along the inclined portion 90*b* and reaches the upper surface 90*d* of the protective member 90 (FIG. 10C). Subsequently, when the sheet cassette C1 is pushed in or drawn out, the lower end portion 20*a* of the cover 20 and the upper surface 90*d* of the protective member 90 slide against each other. Since the inclined portions 90*b* and 90*c* and the upper surface 90*d* of the protective member 90 are formed in a smooth and flat manner such that nothing becomes caught, the possibility of the protective member 90 and the cover 20 becoming damaged owing to the sliding between the cover 20 and the bottom 90*a* is low.

Note that in the present exemplary embodiment, both the sheet guide surface 10 and the drawing out direction restricting member 7 are protected; however, the drawing out direction restricting member 7 alone can be protected. For example, if there is no risk of the sheet guide surface 10 coming into contact with the cover 20, the height and the range of protection of the protective member 90 are set such that only the drawing out direction restricting member 7 is protected.

Third Exemplary Embodiment

The present exemplary embodiment is an exemplary embodiment in which a component that prevents the protective member 90 from collapsing has been added to the second exemplary embodiment. Aiming to prevent a collapse, an abutment portion 90*e* is provided in the protective member 90 and an abutment surface 11*a* is provided in the sheet cassette C1. Other than the abutment portion 90*e* and the abutment surface 11*a*, the configuration of the present exemplary embodiment is similar to that of the second exemplary embodiment.

A technical problem that is to be overcome with the present exemplary embodiment will be described first. The protective member 90 is attached so as to hold the box-shaped side wall 11 in between. Furthermore, the side plate portions 92 and 93 holding the side wall 11 in between are formed with elasticity so at to enable the protective member 90 to be detachably attachable. Accordingly, when the protective member 90 receives a downwards load with the cover 20, as illustrated in FIG. 12B, there are cases in which the protective member 90 collapses in the arrow direction while opening the side plate portions 92 and 93. When the protective member 90 collapses in the arrow direction, the vertical position of the upper surface 90*d* of the protective member 90 becomes lower, and the lower end portion 20*a* of the cover 20 accordingly approaches the upper surface 7*a* of the drawing out direction restricting member 7. When the lower end portion 20*a* of the cover 20 becomes lower than the upper surface 7*a* of the drawing out direction restricting member 7, the function of protecting the drawing out direction restricting member 7 cannot be exerted sufficiently. Accordingly, the collapsing of the protective member 90 needs to be reduced.

Figure 12B:
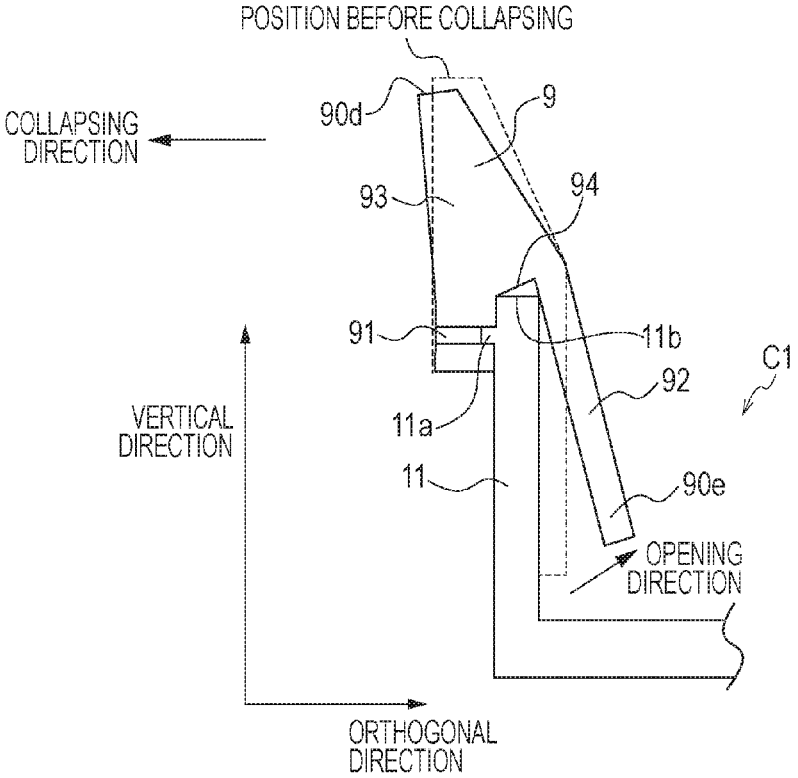
Figure 13:
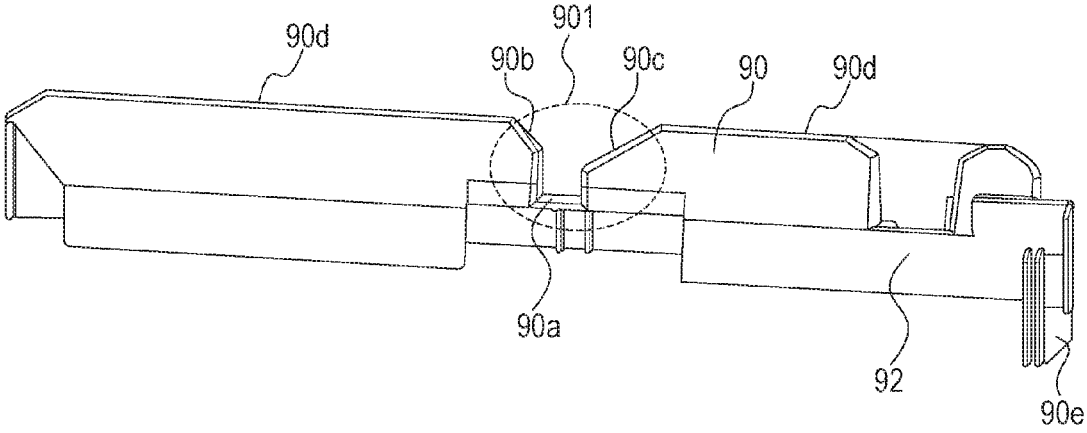
FIG. 13 is a general view of a protective member according to the third exemplary embodiment.

In the present exemplary embodiment, an abutment portion 90*e* is provided in a portion of the side plate portion 92 of the protective member 90 (FIG. 13). When the protective member 90 collapses in the collapsing direction illustrated in FIG. 12B, the side plate portions 92 and 93 begins to open as illustrated in FIG. 12B. When the side plate portions 92 and 93 begins to open, as illustrated in FIG. 12B, the abutment portion 90*e* moves in an opposite direction (the opening direction) with respect to the collapsing direction.

Figure 12A:
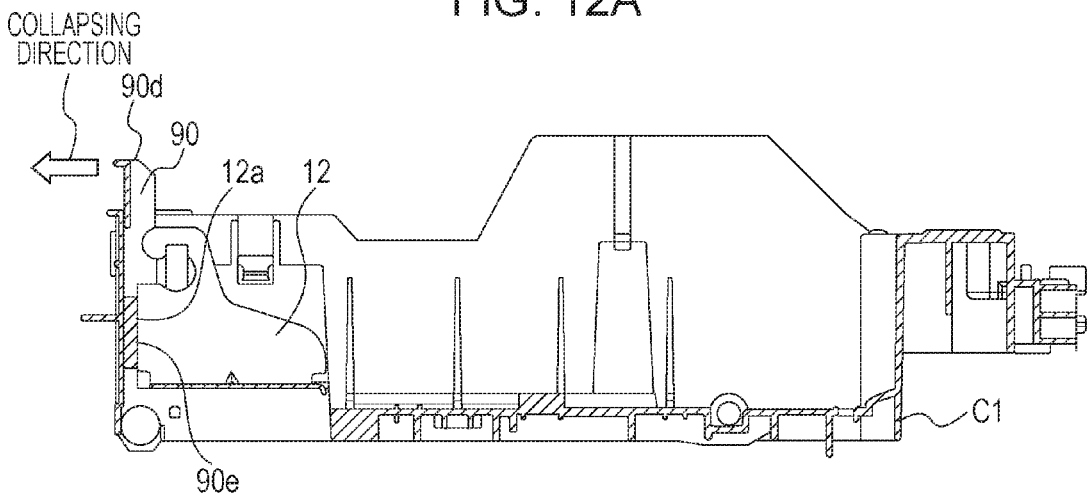
FIGS. 12A and 12B are explanatory drawings of a sheet storing portion according to a third exemplary embodiment.

Accordingly, in the present exemplary embodiment, an end face 12*a* of a sheet stacking plate 12 is disposed on the right with respect to the abutment portion 90*e* (FIG. 12A). When the protective member 90 begins to collapse in the collapsing direction, the abutment portion 90*e* abuts against the end face 12*a*. The abutment portion 90*e* abutting against the end face 12*a* restricts side plate portions 92 and 93 from opening. By restricting the side plate portions 92 and 93 from opening, the collapsing of the protective member 90 is reduced and the aim of the present exemplary embodiment can be achieved.

In the present exemplary embodiment, collapsing is prevented by abutting the abutment portion 90*e* provided at one end of the protective member 90 against the sheet stacking plate 12; however, the position of the abutment portion 90*e* and the target to abut against are not limited to the above. As long as the abutment portion 90*e* is positioned outside a sheet storing area for storing the stack of sheets P and as long as the abutting target does not move when the protective member 90 collapses, the protective member 90 can be prevented from collapsing.

Fourth Exemplary Embodiment

In the present exemplary embodiment, the shape of the cover 20 and the range of protection of the protective member are different from the first exemplary embodiment. Other components are similar to those of the first exemplary embodiment.

Figure 14A:
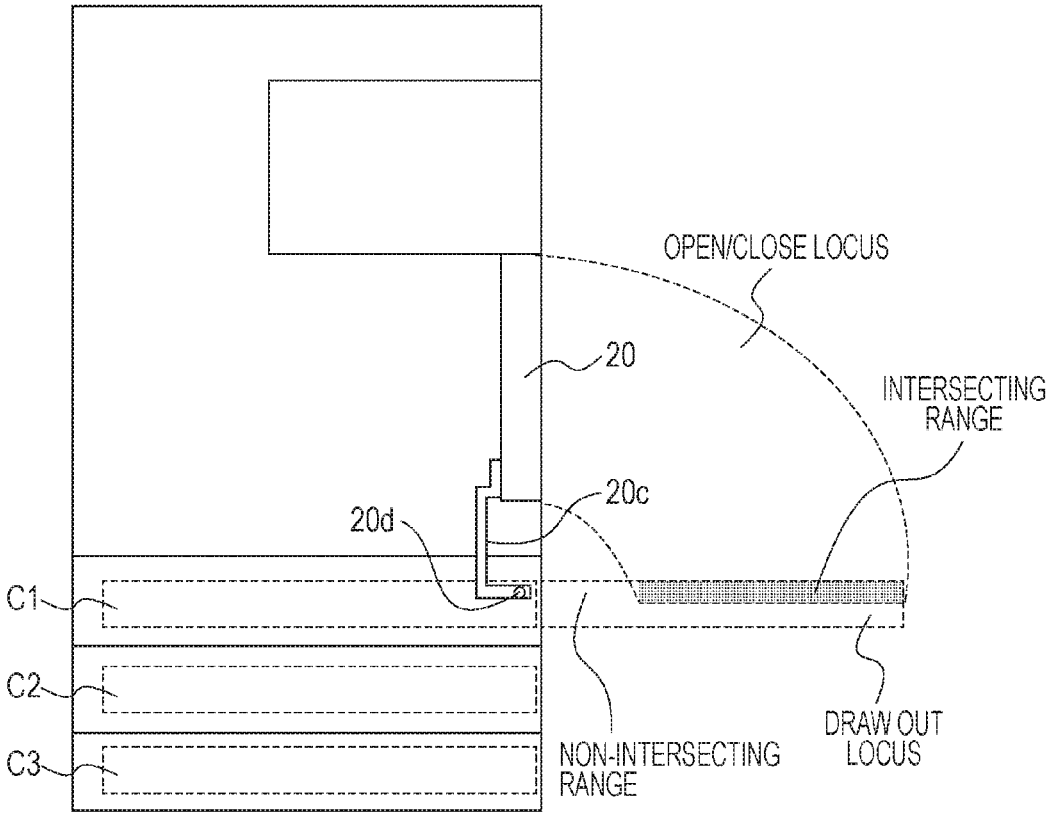
FIGS. 14A and 14B are explanatory drawings of a sheet storing portion according to a fourth exemplary embodiment.

As illustrated in FIG. 14A, the lower end portion of the cover 20 is positioned at a position that is higher than the position of the lower end portion of the first exemplary embodiment (see FIGS. 2A to 2D). Accordingly, an intersecting range in which the draw out locus of the sheet cassette C1 and the open/close locus of the cover 20 intersect each other and a non-intersecting range in which the draw out locus of the sheet cassette C1 and the open/close locus of the cover 20 do not intersect each other exist on a same plane. As for the non-intersecting range, since the cover 20 and the sheet cassette C1 do not come in contact with each other, there is no need for protection.

Figure 14B:
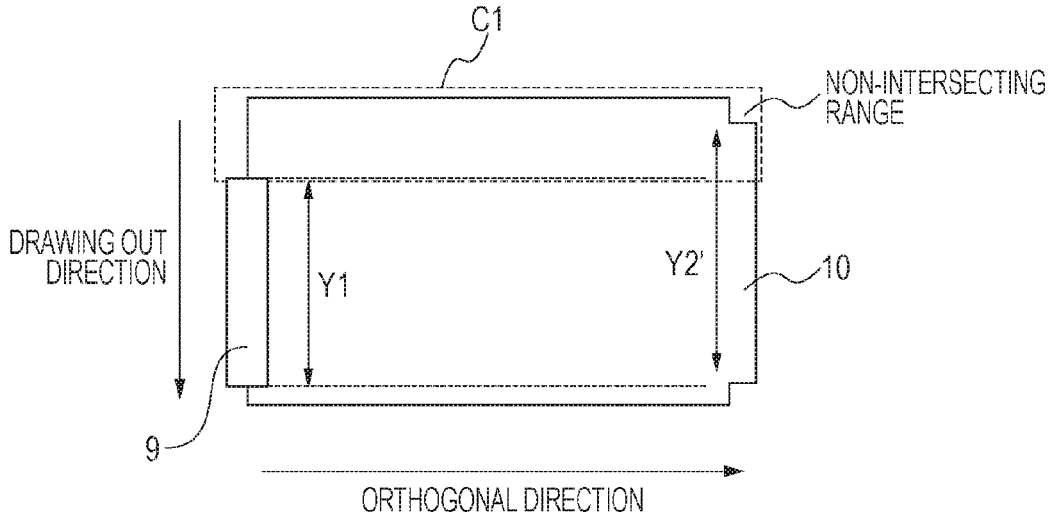

In the present exemplary embodiment, as illustrated in FIG. 14B, a range Y2' in which the sheet guide surface 10 extends in the drawing out direction is larger than a range Y1 of protection by the protective member. In the range Y2', the range that does not overlap the range Y1 of protection is not protected by the protective member. Since the unprotected range is the non-intersecting range, there is no need for protection in the first place. As described above, combination with the non-intersecting range enables the range in which the protective member extends to be smaller than the range in which the sheet guide surface extends. The present exemplary embodiment is effective when the protective member is to be configured small.

Fifth Exemplary Embodiment

The present exemplary embodiment is a combination of the second exemplary embodiment and the fourth exemplary embodiment. With respect to the second exemplary embodiment, the shape of the cover 20 and the range of protection of the protective member differ. Note that similar to the fourth exemplary embodiment, the non-intersecting range in which the cover and the sheet cassette do not intersect each other exists (see FIG. 14A).

Figure 15:
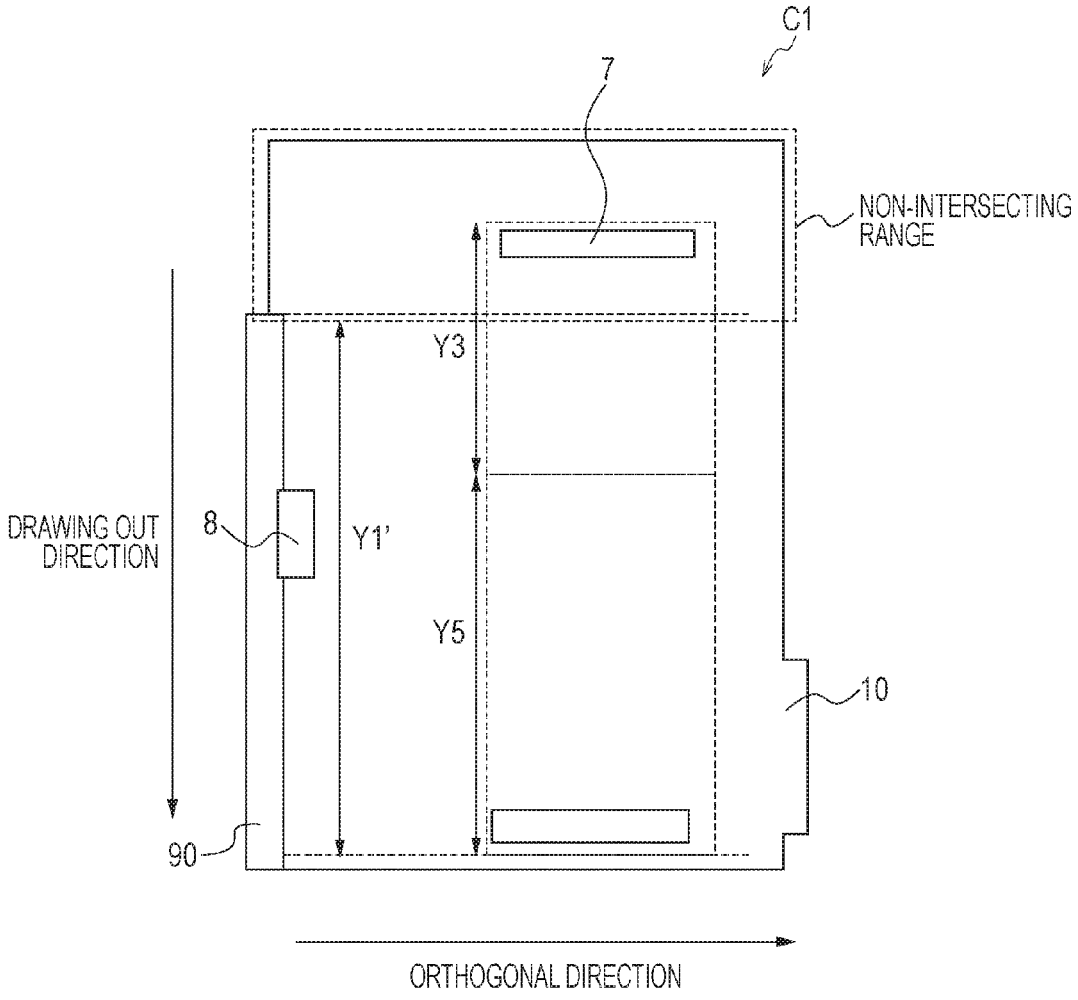
FIG. 15 is an explanatory drawing of a sheet storing portion according to a fifth exemplary embodiment.

In the present exemplary embodiment, as illustrated in FIG. 15, there is a portion in which the movable range Y3 of the drawing out direction restricting member 7 and the range Y1' of protection (FIG. 9B) do not overlap each other. However, since the portion that is not overlapped is included in the non-intersecting range, the cover 20 does not enter the portion in front or behind the drawing out direction restricting member 7. Accordingly, the protective member 90 can be reduced in size without compromising the deformation prevention function of the drawing out direction restricting member 7.

While aspects of the present invention have been described with reference to exemplary embodiments, it is to be understood that the aspects of invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-161354, filed Aug. 18, 2015, which is hereby incorporated by reference herein in its entirety.

What is claimed is:

1. An image forming apparatus that forms an image on a sheet, the image forming apparatus comprising:

a sheet storing portion, storing a sheet therein, mountable in a main body of the image forming apparatus and capable of being drawn out of the main body;

a feeding unit configured to feed the sheet stored in the sheet storing portion;

a cover disposed vertically above the sheet storing portion and capable of moving between a closed position and an open position; and a protective member, wherein the sheet storing portion includes a side wall and a sheet guide surface that guides the sheet fed with the feeding unit, wherein in a state where the sheet storing portion is drawn out from the main body, when the cover is moved from the closed position towards the open position, the cover comes into contact with the protective member and does not come in contact with the sheet guide surface, and wherein the protective member is provided on the side wall in a detachably attachable manner.

2. The image forming apparatus according to claim 1, wherein the sheet storing portion includes an orthogonal direction restricting member that restricts a position of the sheet in an orthogonal direction that is orthogonal to a drawing out direction of the sheet storing portion, wherein the orthogonal direction restricting member is movable in the orthogonal direction, wherein the protective member includes a recess portion, and wherein a position of a bottom of the recess portion in a vertical direction is positioned at a lower position with respect to a position of an upper surface of the orthogonal direction restricting member.

3. The image forming apparatus according to claim 2, wherein an inclined portion is provided at a portion that connects the recess portion of the protective member and the upper surface to each other.

4. The image forming apparatus according to claim 1, wherein the protective member includes a pair of opposing side plate portions, wherein a positioning hole is provided in one of the side plate portions, wherein a positioning boss is provided in the side wall, the positioning boss intruding into the positioning hole to set the position of the protective member with respect to the side wall, and wherein the pair of side plate portions hold the side wall of the sheet storing portion in between.

5. The image forming apparatus according to claim 1, wherein the protective member includes a vertical direction restriction surface that restricts a position in a vertical direction by abutting against the side wall.

6. The image forming apparatus according to claim 1, wherein the protective member includes an abutment portion at a portion outside a sheet storing area, wherein the sheet storing portion includes an abutment surface at a portion outside the sheet storing area, and wherein the abutment portion abuts against the abutment surface so as to restrict collapsing of the protective member.

7. The image forming apparatus according to claim 1, further comprising:

An another sheet storing portion that does not include the protective member, wherein the another sheet storing portion is provided vertically below the sheet storing portion including the protective member.

8. The image forming apparatus according to claim 1, wherein the cover is rotatably provided about a rotation axis, the rotation axis extending in a direction orthogonal to a drawing out direction of the sheet storing portion.

9. The image forming apparatus according to claim 1, further comprising:

an image forming member configured to form an image on a sheet fed from the feeding unit, and wherein the image forming member is exposed when the cover is opened.

10. An image forming apparatus that forms an image on a sheet, the image forming apparatus comprising:

a sheet storing portion, storing a sheet therein, mountable in a main body of the image forming apparatus and capable of being drawn out of the main body;

a feeding unit configured to feed the sheet stored in the sheet storing portion;

a cover disposed vertically above the sheet storing portion and capable of being opened and closed; and a protective member, wherein the sheet storing portion includes a side wall and a sheet guide surface that guides the sheet fed with the feeding unit, wherein the protective member is attached to the side wall in a detachably attachable manner so that the cover does not come in contact with the sheet guide surface, wherein the side wall and the sheet guide surface are provided in the sheet storing portion at different positions in an orthogonal direction that is orthogonal to a drawing out direction of the sheet storage portion, wherein the cover is mounted across the protective member attached to the side wall and the sheet guide surface in the orthogonal direction, wherein a draw out locus of the sheet storing portion and an open/close locus of the cover intersect each other, wherein, in the drawing out direction, a range in which an upper surface of the protective member extends overlaps at least a portion of a range in which the sheet guide surface extends, and wherein the upper surface of the protective member is vertically positioned at a position higher than a position of the sheet guide surface.

11. The image forming apparatus according to claim 10, wherein the range in which the sheet guide surface extends in the drawing out direction is included in the range in which the upper surface of the protective member extends.

12. The image forming apparatus according to claim 10, wherein the sheet storing portion includes the drawing out direction restricting member that restricts a position of the sheet in the drawing out direction, wherein the drawing out direction restricting member is movable in the drawing out direction in accordance with a size of the sheet, wherein, in the drawing out direction, a movable range of the drawing out direction restricting member overlaps at least a portion of a position where the upper surface of the protective member exists, and wherein in a vertical direction, a position of the upper surface of the protective member is positioned at a higher position with respect to an upper surface of the drawing out direction restricting member.

13. The image forming apparatus according to claim 12, wherein the movable range of the drawing out direction restricting member is included in the range in which the upper surface of the protective member extends.

14. An image forming apparatus that forms an image on a sheet, the image forming apparatus comprising:

a sheet storing portion, storing a sheet therein, mountable in a main body of the image forming apparatus and capable of being drawn out of the main body;

a cover disposed vertically above the sheet storing portion and capable of moving between a closed position and an open position; and a protective member, wherein the sheet storing portion includes a side wall and a drawing out direction restricting member that restricts a position of the sheet in a drawing out direction of the sheet storing portion, wherein in a state where the sheet storing portion is drawn out from the main body, when the cover is moved from the closed position towards the open position, the cover comes into contact with the protective member and does not come in contact with the drawing out direction restricting member, and wherein the protective member is provided on the side wall in a detachably attachable manner.

15. The image forming apparatus according to claim 14, wherein the sheet storing portion includes an orthogonal direction restricting member that restricts a position of the sheet in an orthogonal direction that is orthogonal to the drawing out direction, wherein the orthogonal direction restricting member is movable in the orthogonal direction, wherein the protective member includes a recess portion, and wherein a position of a bottom of the recess portion in a vertical direction is positioned at a lower position with respect to a position of an upper surface of the orthogonal direction restricting member.

16. The image forming apparatus according to claim 15, wherein an inclined portion is provided at a portion that connects the recess portion of the protective member and the upper surface to each other.

17. The image forming apparatus according to claim 14, wherein the protective member includes a pair of opposing side plate portions, wherein a positioning hole is provided in one of the side plate portions, wherein a positioning boss is provided in the side wall, the positioning boss intruding into the positioning hole to set the position of the protective member with respect to the side wall, and wherein the pair of side plate portions hold the side wall of the sheet storing portion in between.

18. The image forming apparatus according to claim 14, wherein the protective member includes a vertical direction restriction surface that restricts a position in a vertical direction by abutting against the side wall.

19. The image forming apparatus according to claim 14, wherein the protective member includes an abutment portion at a portion outside a sheet storing area, wherein the sheet storing portion includes an abutment surface at a portion outside the sheet storing area, and wherein the abutment portion abuts against the abutment surface so as to restrict collapsing of the protective member.

20. The image forming apparatus according to claim 14, further comprising:

An another sheet storing portion that does not include the protective member, wherein the another sheet storing portion is provided vertically below the sheet storing portion including the protective member.

21. The image forming apparatus according to claim 14, wherein the cover is rotatably provided about a rotation axis, the rotation axis extending in a direction orthogonal to the drawing out direction.

22. The image forming apparatus according to claim 14, further comprising:

an image forming member configured to form an image on a sheet fed from the feeding unit, and wherein the image forming member is exposed when the cover is opened.

23. An image forming apparatus that forms an image on a sheet, the image forming apparatus comprising:

a sheet storing portion, storing a sheet therein, mountable in a main body of the image forming apparatus and capable of being drawn out;

a cover disposed vertically above the sheet storing portion and capable of being opened and closed; and a protective member, wherein the sheet storing portion includes a side wall and a drawing out direction restricting member that restricts a position of the sheet in a drawing out direction of the sheet storing portion, wherein the protective member is attached to the side wall in a detachably attachable manner so that the cover does not come in contact with the restricting member, wherein the side wall and the restricting member are provided in the sheet storing portion at different positions in an orthogonal direction that is orthogonal to a drawing out direction of the sheet storage portion, wherein the cover is mounted across the protective member provided on the side wall and the restricting member in the orthogonal direction, wherein a draw out locus of the sheet storing portion and an open/close locus of the cover intersect each other, wherein the drawing out direction restricting member is movable in the drawing out direction in accordance with a size of the sheet, wherein, in the drawing out direction, a range in which an upper surface of the protective member extends overlaps at least a portion of a movable range of the drawing out direction restricting member, and wherein the upper surface of the protective member is vertically positioned at a position higher than a position of an upper surface of the drawing out direction restricting member.

24. The image forming apparatus according to claim 23, wherein the movable range of the drawing out direction restricting member is included in the range in which the upper surface of the protective member extends.

* * * * *